US005484996A

United States Patent [19]

Wood

[11] Patent Number: 5,484,996

[45] Date of Patent: Jan. 16, 1996

[54] BAR CODE DISABLING SYSTEM

[76] Inventor: Lynn E. Wood, 12313 Ottawa Ave., South, Shakopee, Minn. 55378

[21] Appl. No.: 220,822

[22] Filed: Mar. 31, 1994

[51] Int. Cl.[6] ..... G09F 3/10

[52] U.S. Cl. ..... 235/487; 40/628; 285/81

[58] Field of Search ..... 235/487, 494, 235/462, 489, 438, 439; 283/100, 101, 103, 104, 105, 107, 109, 81; 40/638

[56] References Cited

U.S. PATENT DOCUMENTS

| | | | |
|---|---|---|---|
| 2,818,168 | 12/1957 | Tobey et al. | 283/81 |
| 3,211,470 | 10/1965 | Wilson | 283/103 |
| 3,750,317 | 8/1973 | Morgan | 283/81 |
| 3,822,492 | 7/1974 | Crawley | 283/81 |
| 4,121,003 | 10/1978 | Williams | 428/40 |
| 4,995,642 | 2/1991 | Juszak et al. | 283/105 |
| 5,042,842 | 8/1991 | Green et al. | 283/101 |
| 5,052,718 | 10/1991 | Gold | 283/101 X |
| 5,109,153 | 4/1992 | Johnson et al. | 235/468 |

FOREIGN PATENT DOCUMENTS

| | | | |
|---|---|---|---|
| 2408182 | 7/1979 | France | 283/100 |
| 2692393 | 2/1993 | France | 40/638 |
| 3417226 | 11/1985 | Germany | 40/638 |
| 5012504 | 1/1993 | Japan | 235/494 |
| 2053140 | 2/1981 | United Kingdom | 40/638 |
| 2210349 | 6/1989 | United Kingdom | 283/81 |

*Primary Examiner*—John Shepperd
*Attorney, Agent, or Firm*—Hugh D. Jaeger

[57] ABSTRACT

A bar code disabling system for disabling a bar code to prevent reading of the bar code. The purpose of disabling the bar code is so that the bar code cannot be used to direct containers to the wrong locations when the bar codes are utilized for optical scanning and sorting.

7 Claims, 3 Drawing Sheets

BAR CODE DISABLING SYSTEM

CROSS REFERENCES TO CO-PENDING APPLICATIONS

None.

BACKGROUND OF THE INVENTION

1. Field of the Invention

The present invention relates to bar code labels, such as for optical scanning and sorting, and more particularly, pertains to a bar code disabling system for disabling the bar code on a reusable shipping container so that the container will not be optically scanned and subsequently sorted, such as to the wrong destination because a previous bar code had not been removed.

2. Description of the Prior Art

Prior art bar codes have generally been left on containers, until the time of next use for the container. The label needed to adhere well enough to stay on the shipping container during container use yet be readily removable. The removal of the bar code label being the method used to destroy the bar code information.

Extremes of temperature, passage of time, and the compaction of container surfaces acted to bond some bar code labels permanently to some containers. Thus consistent and predictable removal of the old bar code could not be accomplished. Frequently an old bar code label bearing valid information would be left on a container when a new label was applied.

What would happen is that during the sorting of a container, the old bar code would sometimes be read instead of the new bar code label and so the container would be misdirected to the wrong destination. This would cause delay of the container and contents and sometimes loss of revenues.

The present invention overcomes the disadvantages of the prior art by providing a bar code disabling system for removing bar code information sufficient to destroy the validity of the bar code. The system is self contained within the label.

SUMMARY OF THE INVENTION

The general purpose of the present invention is to provide a bar code disabling system for disabling the bar code, such as a bar code label on a shipping container. A pull away strip is provided in the bar code to either tear a portion of the bar code off the shipping container or lift the bar code off of the shipping container.

According to one embodiment of the present invention, there is provided a bar code disabling system having a bar code label with a peel-away strip, which is either mounted on the top surface of the bar code label or the bottom surface of the bar code label, and which when peeled away, disables the bar code. The peel-away strip can be a lift off flap or tab to provide ease of digital finger control for pulling away that portion of the bar code label.

Significant aspects and features of the present invention provide a bar code disabling system which is easily utilizable by anyone just by the use of their fingers in lifting up a part of the bar code, and tearing away that part of the bar code, which then disables the bar code label.

Another significant aspect and feature of the present invention is a process which applies to bar codes usually used in the optical scanning and subsequent sorting of shipping containers, such as in air express containers, or in any other type of container where bar code labels are used for routing or directing the container. The lift off portion of the bar code label runs parallel to the bar code lines of the bar code label, and is of such a width of the bar code label so as to disable the bar code label. By disabling the bar code label, optical scanning and sorting cannot occur.

Having thus described embodiments of the present invention, it is a principal object hereof to provide a bar code disabling system.

One object of the present invention is to provide a bar code disabling system which is easily utilized by lifting a tab or flap and pulling that flap along the bar code label to disable the bar code label.

Another object of the present invention is the process of providing a tear-away portion of the bar code label which can be easily engaged by an individual's two fingers for subsequent pulling away of the bar code label.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
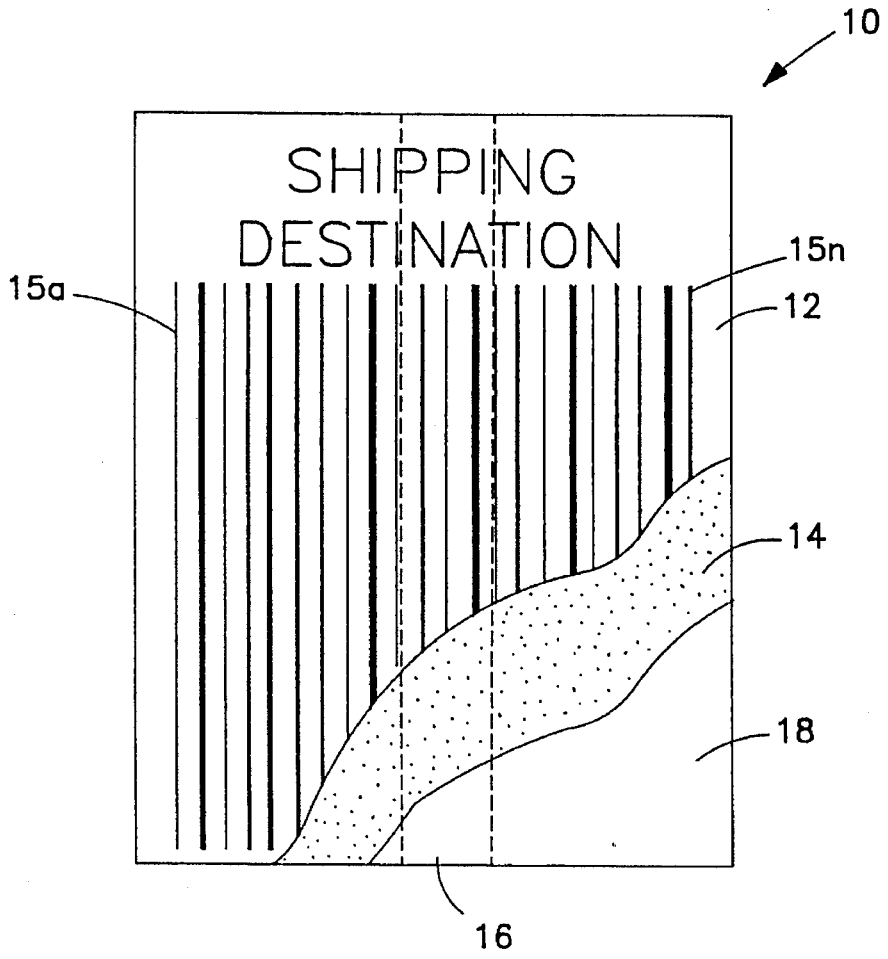
FIG. 1 illustrates a front cutaway view of a bar code label disabling system, the present invention.
Figure 2:
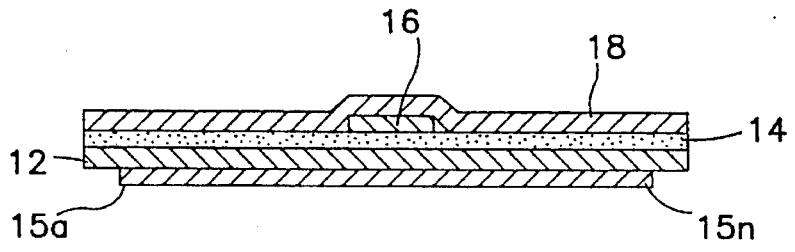
FIG. 2 illustrates a conceptual top view of the present invention.

FIGS. 1 and 2 illustrate a front cutaway view and conceptual top view, respectively, of a bar code disabling system 10, the present invention, including a rectangular bar code label 12 with adhesive 14 on a back side, a plurality of bar code lines 15*a*–15*n* on the front side, a Mylar or other suitable polymer material strip 16 engaged to the adhesive 14 on the back side, and a protective covering 18, which engages over the adhesive 14 and the Mylar strip 16, that is removed prior to application of the bar code label including the Mylar strip 16 to a container. Other suitable materials such as fiber board, polymers, plastics, etc., can be utilized. In the disabling operation, a person's fingers engage under the bar code label 12 of an applied bar code label 12 at the top or the bottom to grasp and lift up the Mylar strip 16 which is subsequently pulled away and parallel to the bar code lines 15*a*–15*n* on the bar code label 12, thereby removing a number of bar code lines 15*a*–15*n* rendering the bar code label 12 disabled.

Figure 3:
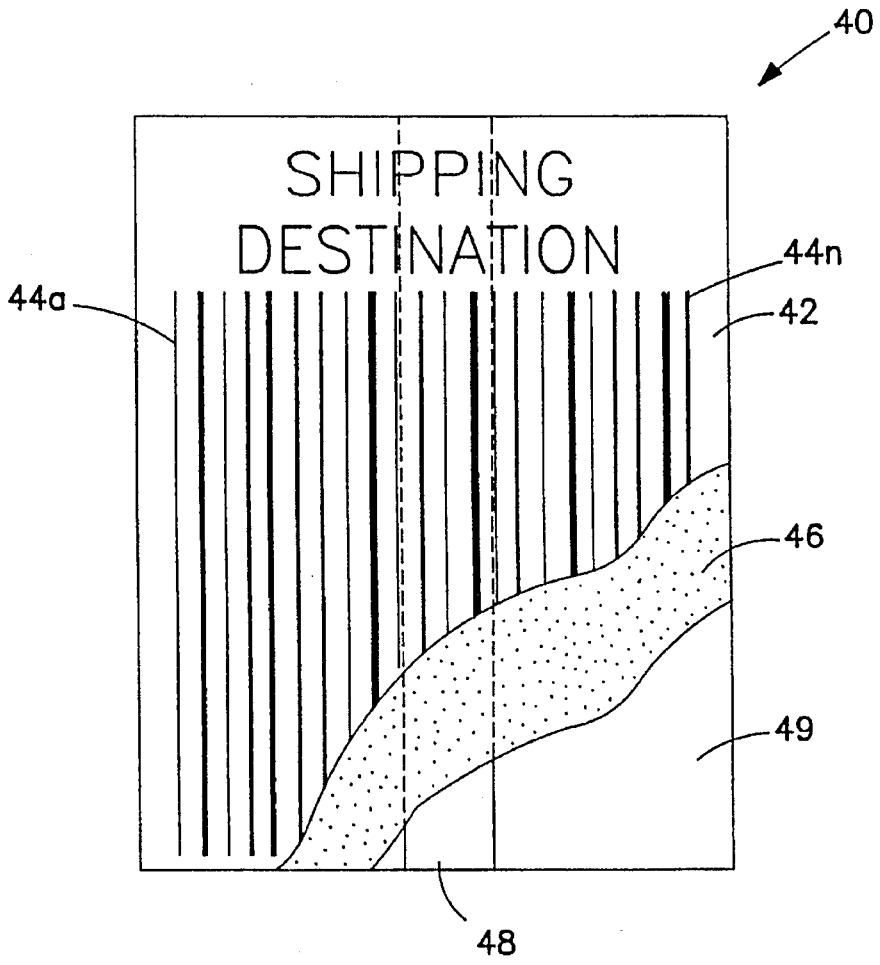
FIG. 3 illustrates a first alternative embodiment of FIG. 1 with a die cut bar code disabling system.

FIG. 3 illustrates a front view of a bar code disabling system 40, the present invention, including a label 42, often referred to as a bar code routing label, and including bar coding lines 44*a*–44*n*, adhesive 46, a Mylar strip 48, a removable backing 49 and a die cut tab 50 for engagement by one's fingers and overlies the upper portion of the Mylar strip 48. The die cut tab 50 may or may not have adhesive. The operation of FIG. 3 is the same as that of FIG. 1 for disabling the bar code and in addition, easy access is afforded the Mylar strip 48 lying behind the die cut tab 50 which is easily folded forward for Mylar strip accessibility.

Figure 4:
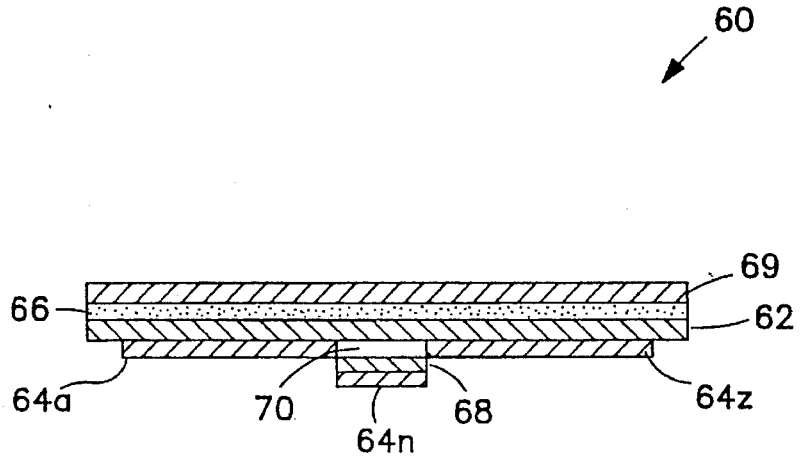
FIG. 4 illustrates a second alternative embodiment of a die cut bar code disabling system; and, FIG. 5 illustrates a bar code reader scanning a bar code disabled package.

FIG. 4 illustrates a conceptual top view of a bar code disabling system 60 having a removable Mylar strip on the front surface of the bar code routing label, including a bar code routing label 62, a bar code having a majority of bars 64*a*–64*z* printed on the bar code routing label 62, and a minority of bar code bars 64*n* on a Mylar strip 68 adhesively engaged by adhesive 70 to the front surface of the bar code routing label 62 which is the reverse of the engagement of the Mylar of that of FIGS. 1 and 2, and having an adhesive 66 and a removable backing 69. It is important that the Mylar be suitably chosen so as to accept normal printing of bar line members, such as on a laser printer, ink jet printer, or normal printing apparatus. The Mylar strip 68, having bar line members 64*n*, is easily removed from between the adjacent and surrounding bar code members 64*a*–84*z* without having to part the bar code routing label as done in previous figures, thus neatly disabling the bar code routing label 62. The Mylar strip 68 may be incorporated on the front of a bar code disabling system having the general rectangular shape such as that illustrated in FIG. 1 or may also be incorporated on the front of a bar code disabling system having a die cut tab such as that illustrated in FIG. 3.

Figure 5:
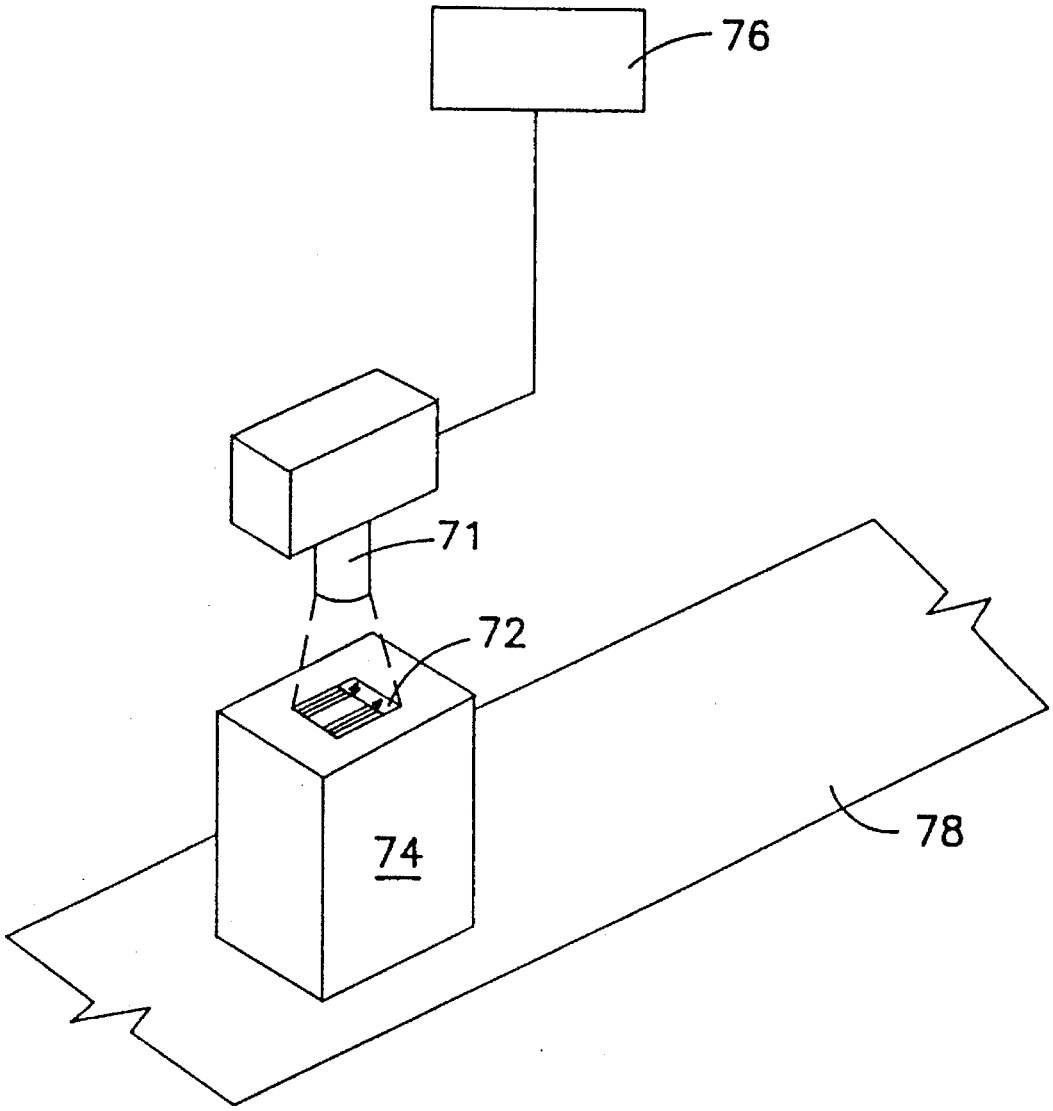

FIG. 5 illustrates a bar code reader 71 scanning a disabled bar code label 72 on a container or package 74 where all numerals correspond toot hose elements previously described. A computer 76 is able to detect the disabled bar code label 72 and instruct downline package handling equipment to remove the package 74 from a package handling system conveyor 78 where special handling is received.

MODE OF OPERATION

The Mylar strip is the key aspect, including the aspect of the combination of the Mylar strip with the bar code label in disabling the bar code. The process of tearing away the Mylar strip from the bar code provides for the disabling of the bar code because the optical reader is not able to read an entire bar code. It is important that the Mylar strip or a strip of any other suitable material be selectively placed with respect to the bar code so as to disable the entire bar code, and also that the bar code reading apparatus be programmed so that when a gap is detected that this gap in the bar code indicates that the bar code is disabled.

Various modifications can be made to the present invention without departing from the apparent scope hereof.

I claim:

1. A postal bar code disabling system comprising:

a. a label;

b. adhesive on one side of said label;

c. a bar code on another side of said label; and, d. a polymer disabling strip engaged to the adhesive and of such a width as to disable the bar code whereby when said disabling strip is pulled between the edges of the bar code, the bar code is disabled so that an optical scan and sort process cannot be enabled whereby said strip is pulled substantially parallel to said bars thereby creating a gap.

2. The system of claim 1 including means for sensing a disabled bar code.

3. The system of claim 1 wherein said bar code is a postal bar code label.

4. A postal bar code disabling system comprising:

a. a label of material;

b. adhesive on one side of said label;

c. a bar code on another side of said label;

d. a polymer disabling strip engaged to the adhesive and of such a width as to disable the bar code whereby when said disabling strip is pulled between the edges of the bar code whereby the bar code is disabled so that an optical scan and sort process cannot be enabled; and, e. means to sense a disabled bar code whereby said strip is pulled substantially parallel to said bars thereby creating a gap.

5. Process for sensing a disabled postal bar code comprising:

a. engaging a strip of material of a width to disable a bar code on a label;

b. pulling the disabling strip along the length of the bar code of such a width so as to disable an optical reading of the bar code so that a sort operation cannot be enabled; and, c. sensing a disabled bar code when said strip is pulled substantially parallel to said bars thereby creating a gap.

6. The process of claim 5 wherein said bar code is a postal bar code label.

7. A bar code disabling system comprising, in order:

a. a label;

b. an adhesive backing for said label;

c. a polymer strip;

d. an adhesive backing for the polymer strip attaching said polymer strip to the front of the label and;

e. a bar code printed on the front of the label and polymer strip with the bars substantially parallel to said polymer strip whereby when said strip is pulled off said label a gap is created in said bar code which disables said bar code so that an optical scan and sort process cannot be enabled.

* * * * *